United States Patent [19]

Kincer et al.

[11] Patent Number: 4,942,643

[45] Date of Patent: Jul. 24, 1990

[54] MECHANICAL COTTONSEED DELINTER

[76] Inventors: Louis T. Kincer; Dale R. Kincer; Denny L. Kincer, all c/o L. T. Kincer Co., 3509 Globe Ave., Lubbock, Tex. 79404

[21] Appl. No.: 380,332

[22] Filed: Jul. 17, 1989

[51] Int. Cl.[5] ..... D01R 1/00

[52] U.S. Cl. ..... 19/44; 19/41

[58] Field of Search ..... 19/39, 40, 41, 42, 43, 19/44, 45, 46, 47, 48 R, 58, 60, 61

[56] References Cited

U.S. PATENT DOCUMENTS

| | | | |
|---|---|---|---|
| 94,304 | 8/1869 | Grader | 19/60 |
| 396,996 | 1/1889 | Gennert | 19/44 |
| 397,448 | 2/1889 | Sullivan | 19/44 |
| 546,275 | 9/1895 | Faulkner | 19/41 |
| 546,277 | 9/1895 | Faulkner | 19/41 |
| 556,574 | 3/1896 | Bugg | 19/43 |
| 563,647 | 7/1896 | Boyd | 19/44 |
| 645,169 | 3/1900 | Faulkner | 19/44 |
| 659,840 | 10/1900 | Baxter | 19/44 |
| 662,337 | 11/1900 | Barditzky | 19/43 |
| 907,340 | 12/1908 | Grant | 19/47 |
| 1,014,518 | 1/1912 | Reid | 19/44 |
| 1,246,715 | 11/1917 | Cole | 19/47 |
| 2,242,302 | 5/1941 | Hoefling et al. | 19/42 |
| 2,724,148 | 11/1955 | McMath | 19/44 |

FOREIGN PATENT DOCUMENTS

| | | |
|---|---|---|
| 336383 | 6/1972 | U.S.S.R. . |
| 380756 | 7/1973 | U.S.S.R. . |
| 422801 | 11/1974 | U.S.S.R. . |
| 456858 | 2/1975 | U.S.S.R. . |
| 597749 | 3/1978 | U.S.S.R. . |
| 1061462 | 3/1967 | United Kingdom . |

*Primary Examiner*—Werner H. Schroeder
*Assistant Examiner*—Michael A. Neas

[57] ABSTRACT

A cottonseed delinting machine mechanically delints the cottonseed by a rotating brush system. The period of time for the delinting operation is controlled by a door operating system. The temperature of the cottonseeds is controlled dependent on airflow through the machine and length of time the cottonseeds are subjected to the delinting process. The machine also provides for the recovery of the lint after separation from the cottonseed. The movement and path of travel of the cottonseeds during the delinting process is controlled to ensure a high degree of efficiency in the removal of the lint.

21 Claims, 5 Drawing Sheets

Fig. 4
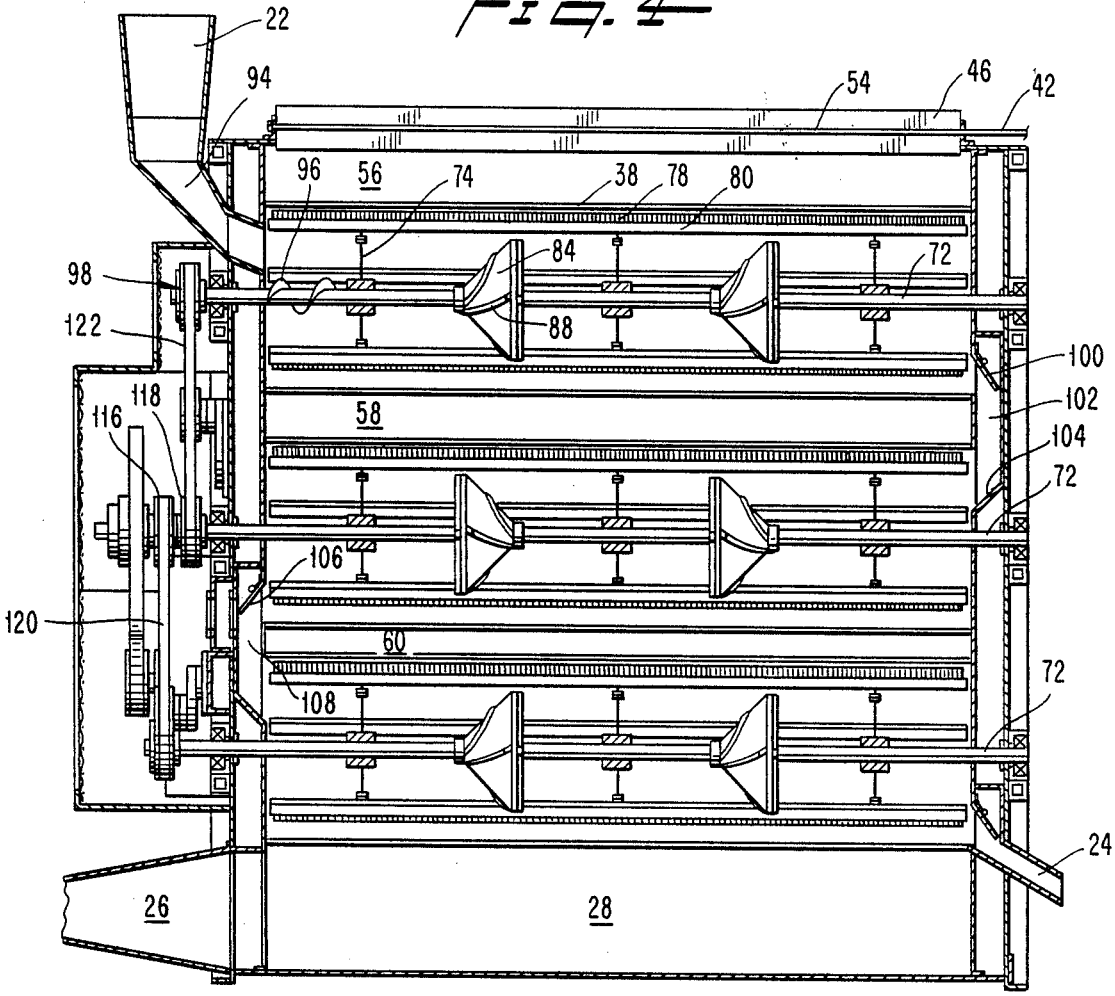
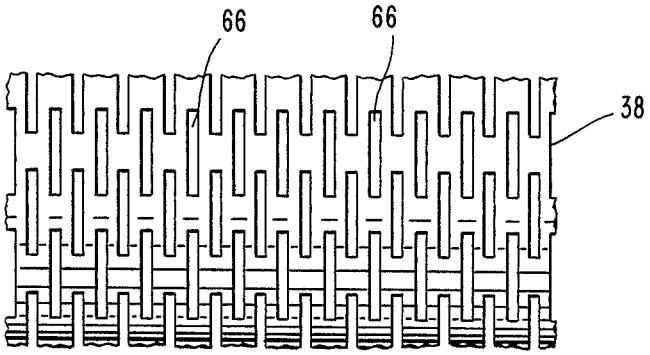
Fig. 5

Fig. 8
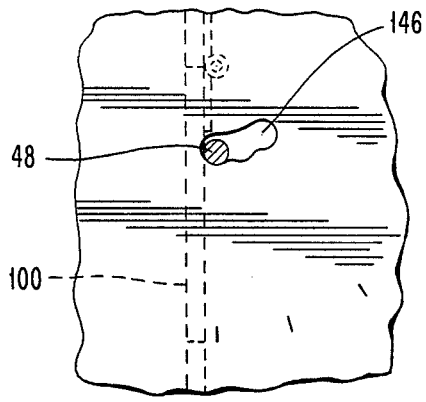
Fig. 9
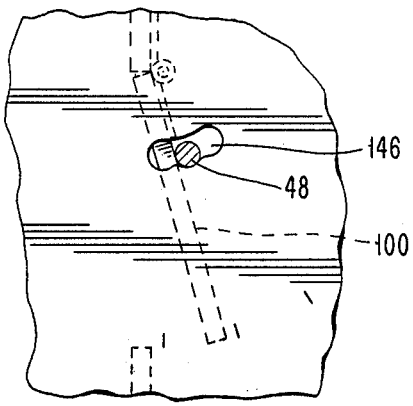
Fig. 10
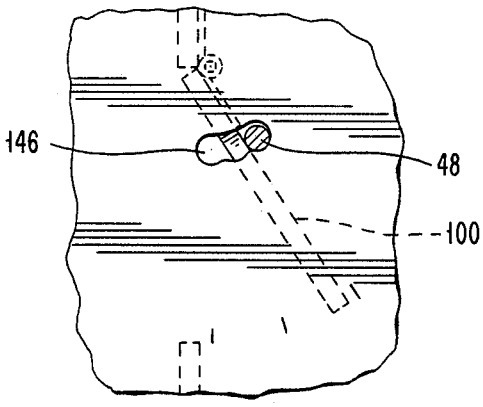
Fig. 11
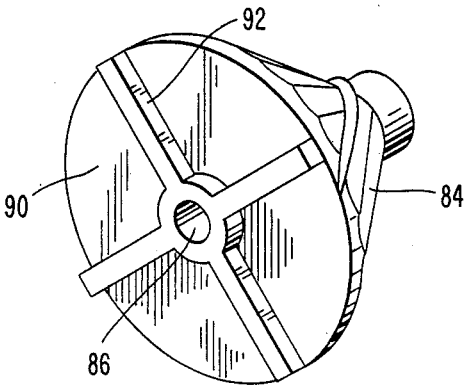
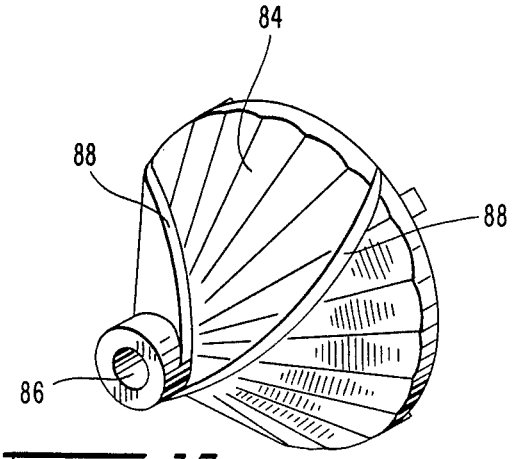
Fig. 12

MECHANICAL COTTONSEED DELINTER

BACKGROUND OF THE INVENTION

1. Field of the Invention

The present invention relates to a mechanical cottonseed delinting device in which it is desired to delint cotton from the cottonseeds without damaging the cottonseeds so as to permit the seeds to be planted. In order to effectively delint such cottonseeds, the machine utilizes a series of cages in which the cottonseeds are trapped between a brush and a screen mesh enclosure so as to be subjected to a series of brushing treatments. The brushing treatments are effective in removing the cotton lint from the cottonseed.

2. Description of the Related Art

The most common methods used today for delinting cottonseed all relate to the use of various chemical processes. The earliest chemical process was to saturate the cottonseed with concentrated sulfuric acid. The short cotton fibers on the seed would quickly disintegrate while generating heat from the reaction of the acid with the moisture in the seed. The residue would be washed away with water. Subsequent to washing, the seed would be required to be neutralized with soda ash, lime or anhydrous ammonia. This method is referred to as the wet acid method. As can be recognized, problems are related to the use of concentrated sulfuric acid since it is extremely corrosive to machinery and dangerous to handle. Further, a large amount of energy is utilized in order to dry the seed. The use of concentrated sulfuric acid also causes soil and water pollution. This has become of increasing concern with various state and federal pollution monitoring and enforcement agencies.

A further chemical delinting process utilized hydrochloric acid to hydrolyze the lint. The advantage of the dry gas or hydrochloric acid system was the elimination of possible ground water pollution. However, the method required the use of a hazardous gas under pressure and was limited to use in a dry climate. The hydrolyzed lint produced by the process is a very fine dust or powder-like consistency and is very difficult to separate in present day air cleaning monitoring systems so as to remove the dust and fumes from the work area before circulating the air outside the plant.

An improved sulfuric acid delinting method was developed using dilute sulfuric acid. This method eliminated the need for a large evaporation pond by recycling the solution not consumed in the process. The dilute acid system required a continuous feed centrifuge which removed water from the dilute acid applied to the seeds so as to concentrate the acid. This chemical process had the disadvantage of using a corrosive acid, was messy, required large amounts of energy to run the centrifuge and to dry the seed. As the centrifuge equipment is extremely expensive and maintenance is very costly, the dilute sulfuric acid system has met with some disfavor. A modification of this process was developed in the early 1980s so as to eliminate the centrifuge and its high cost; however, the modification slows the cleaning process and requires more energy for drying.

Small-scale mechanical delinting systems are also known. Examples of such systems are U.S. Pat. Nos. 396,996; 397,448; 563,647; 645,169; 659,840 and 1,014,518.

U.S. Pat. No. 396,996 is typical of a machine which abrades cottonseed after passing the seed through a cotton gin and a lint removing machine. The object of the disclosure relates to the removal of short lint or fine wool fibers left on the seed after having been cleaned in a gin and linting machine. The short cotton fibers are removed by an abrading action and dropped through slots at the bottom section of the shell of the machine by action of a brush system. The abraded, cleaned seed is delivered at either end.

U.S. Pat. No. 397,448 discloses a machine for delinting cottonseed is again subjected to an abrading surface and therefore, an abrading action. The machine not only removes the cotton lint from the seed, it also strips the seed of the hulls and further damages the seed.

U.S. Pat. No. 563,647 again discloses a cottonseed delinting machine which uses an abrading surface of emery material. A cylindrical outer surface is disclosed as being lined with an abrading material and further abrading material is also provided by an abrading cylinder covered with emery. An inlet opening is provided with a hopper or other pipe through which the seed is fed. Beneath the inlet, an inner cylinder is arranged spirally around its periphery to start the seed toward the opposite end and to push the seed between the abrading surfaces. At the bottom of the outer casing and at the opposite end from the inlet, an outlet is provided for discharging the seed and the lint.

U.S. Pat. No. 645,169 again presents a delinting machine which uses an abrading action for separating the lint from the seed. The perforated abrasive cylinder of the device is coated with emery or other suitable abrasive material. The abrading arrangement is such that abrading blocks 18 are secured to rod 17 and succeeding blocks are offset from one another so as to permit seed and lint to fall between the blocks to the bottom of the receptacle. This arrangement permits the seeds to again be picked up and abraded further by the use of the abrading blocks.

U.S. Pat. No. 659,840 discloses a cottonseed delinter which uses carborundum abrading or grinding wheels mounted in a machine for the delinting of cottonseed. The seed is packed together to such an extent that a grinding action grinds away the lint. Of course, this action damages the seed so as to make the seed unsuitable for planting.

U.S. Pat. No. 1,014,518 discloses a cottonseed delinting machine which again uses a carborundum roller arrangement for abrading the seed. Carborundum rollers are utilized in connection with a main shaft while auxiliary shafts are also provided with an arrangement so that carborundum facings are utilized thereon.

SUMMARY OF THE INVENTION

A new mechanical cottonseed delinting technology has been developed that does not require corrosive acids, does not pollute the environment and is not sensitive to seed moisture. Additionally, the cottonseed delinting technology permits the cleaning of the cottonseed without damaging the seed so as to permit the seed to be reused for planting. Seed cleaning equipment, buildings and other equipment will be able to last much longer and require less maintenance as they will no longer be subjected to the corrosive action of acids. Additionally, the total energy requirement for the new cottonseed delinting technology has been substantially reduced and is substantially less than that which is needed for the present day cottonseed delinting processes. The new apparatus permits a continuous flow system to be utilized and adjustments in the delinting process may be made at any time during the operation so as to provide maximum efficiency with the cleaning of different types of cottonseeds. In this connection it should be noted that there are approximately 130 different types of cottonseeds and each seed has a slightly different characteristic with regard to retaining the cotton lint thereto. As such, some cottonseed may be extremely easy to clean while other cottonseed may be extremely difficult to clean. The adaptability of the current technology to the various types of cleaning requirements is superior to that of other mechanical systems.

The technology disclosed by the present invention simplifies the delinting process and eliminates the use of hazardous chemicals. The seed is less likely to be damaged and it eliminates a source of air and water pollution. Additionally, less energy is required and the operator has much more precise control over the machine during the delinting process.

BRIEF DESCRIPTION OF THE DRAWINGS

FIG. 4 is an interior view, in elevation, of the cottonseed delinting machine;

FIG. 5 is a plan view of a screen element of the cottonseed delinting machine;

FIGS. 8, 9 and 10 are schematic representations of speed adjustment mechanisms for controlling the flow of cottonseed through the machine;

FIG. 11 is a perspective end view of a rotating cone element of the present invention; and FIG. 12 is a front perspective view of the rotating cone element of FIG. 11.

DETAILED DESCRIPTION OF A PREFERRED EMBODIMENT

Figure 1:
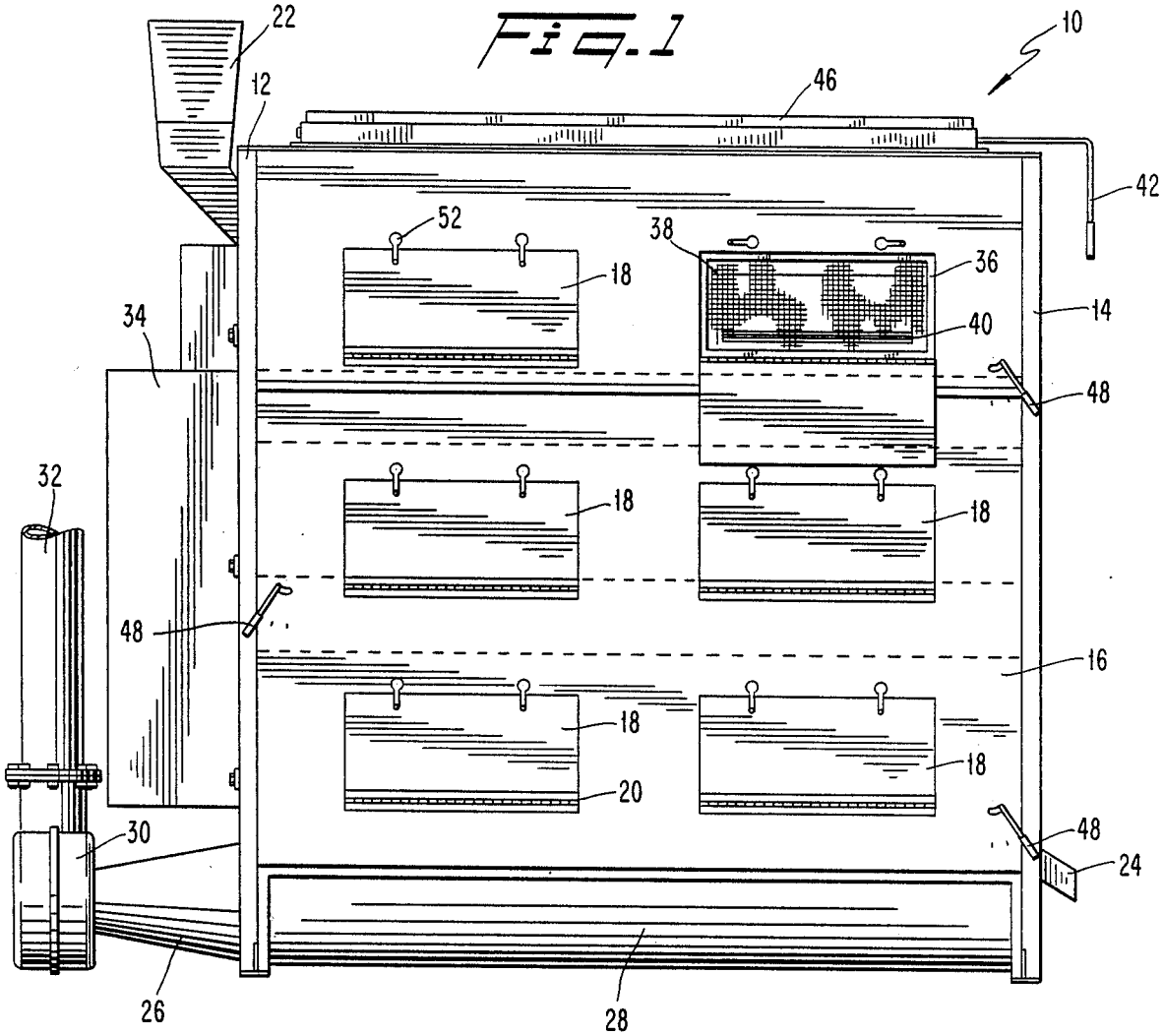
FIG. 1 is a frontal elevation view of the mechanical cottonseed delinter of the present invention.

With regard to FIG. 1, the cottonseed delinting machine of the present invention is indicated generally at reference numeral 10. Therein, frame sections 12 and 14 indicate side frames of the machine and provide support therefor. A front cover is indicated at reference numeral 16 and includes a plurality of doors or ports 18. The ports 18 are hingedly connected to the casing 16 as indicated at reference numeral 20. A hopper feed mechanism is provided at 22 and receives the cottonseed to be delinted via any well known type of automated machinery which would convey the cottonseed to the cottonseed delinting machine. A discharge chute is indicated at reference numeral 24 and is provided for discharging the cleaned cottonseeds. A lint discharge section is identified at 26 and conveys the lint from the bottom 28 of the machine 10 to a cotton lint disposal facility. The cotton lint moves from the bottom 28 of the machine through the pipe or conduit 26 due to the action of a centrifugal-type operator 30 and then to a discharge pipe 32 so that the lint which has been separated from the cottonseed is retained by the air discharge system to an outside stockpile for resale. The lint which has been separated from the cottonseed is termed "moat". A drive system is identified at reference numeral 34 so as to provide for rotation of a plurality of chambers or sections of the machine, as discussed later. The ports 18 are openable so as to permit the interior of the machine to be viewed along different sections. As indicated at reference numeral 36, an open port permits viewing of a screen mesh section 38 as discussed later and in more detail with regard to FIG. 5. The screen mesh sections are also openable as they are hinged along hinge lines 40 so as to provide access to the interior of the screen section. The casing of the machine is designed as a plenum chamber which can be variably controlled by a linkage arrangement indicated at 42 which controls the degree of opening of a top section of the machine casing, the top section being indicated at reference numeral 44 in FIG. 2.

Figure 2:
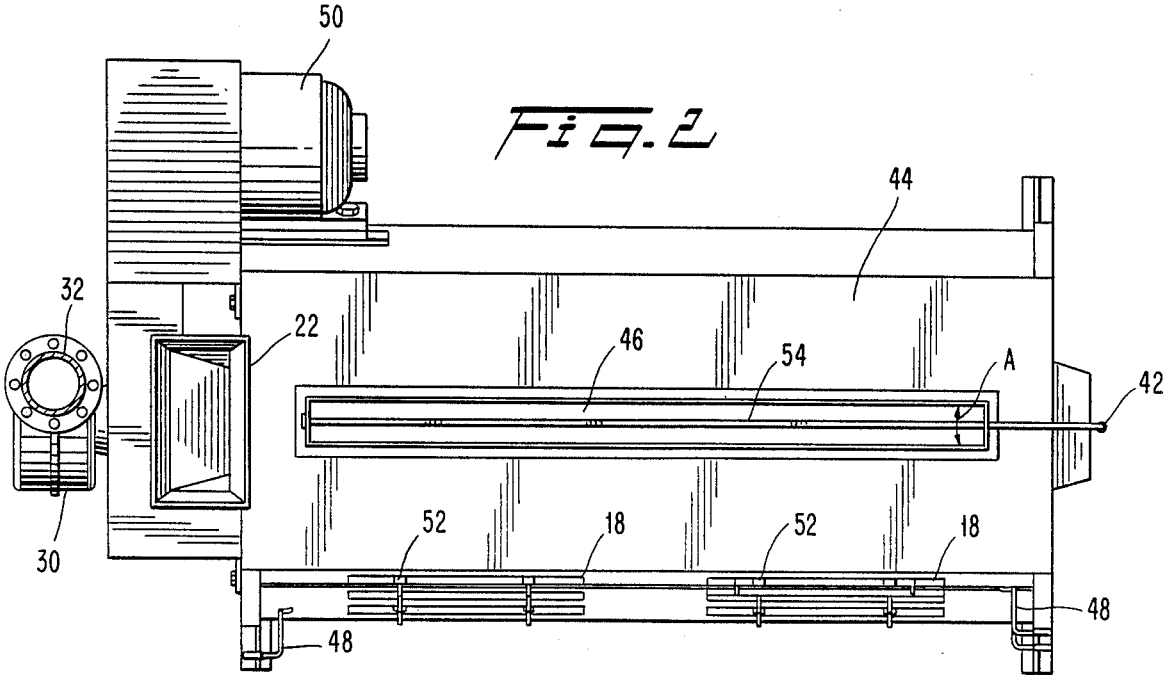
FIG. 2 is a top plan view of the casing arrangement and feed hopper arrangement of the mechanical delinter of FIG. 1.

With reference to FIGS. 1 and 2, the variably controlled vent arrangement is indicated at reference numeral 46 so as to control the amount of heat buildup in the cottonseed delinting machine. The degree of opening is carefully controlled as heat may be built up in the machine during the process of delinting the cottonseed. The continual movement of the cottonseed between the screens and brushes, to be later described, heats the cottonseed to various levels of temperature. If the cottonseed is heated up to a temperature greater than 140°, the seed will not germinate, thereby rendering it useless for planting. Accordingly, the vent arrangement indicated at reference numeral 46 is determinative of the temperature arrangements which must be maintained for the various types of cottonseeds to be delinted.

Also indicated in FIG. 1 is a plurality of lever arrangements 48. The lever arrangements 48 serve to control the degree of opening of various doors from each section or series of the delinting process, each section of the delinting process being discussed with reference to FIGS. 3 and 4. As previously discussed, many different types of cottonseeds require various predetermined times in each of the rotating chambers or sections so as to correctly remove the moat from the cottonseed. As such, the linkages 48 control the size of openings of the doors from each chamber or section and therefore control the amount of cottonseed that can proceed from one chamber or section to the next.

With reference to FIG. 2, the cottonseed delinting machine frame also supports a drive motor 50 which provides the motive power for any well known type conveying apparatus which conveys the cottonseed, to be delinted, to the inlet chute 22. As can be seen from FIGS. 1 and 2, each of the ports 18 may be closed by closure means 52 of any known clamping type. The clamping type closure must function to permit the ports 18 to be opened and to permit the interior of the machine to be inspected. As can be seen from FIG. 2, the plenum chamber opening and the variable closure for the opening is shown in more detail. The linkage 42 connects with a plate member 54, shown in its vertical position, which may be rotated in the direction of the arrow A so as to provide more or less of a degree of opening as indicated at reference numeral 46. Again, the degree of opening is crucial as to determining the proper operating temperature of the machine so as to prevent damage to the cottonseed during the delinting process.

Figure 3:
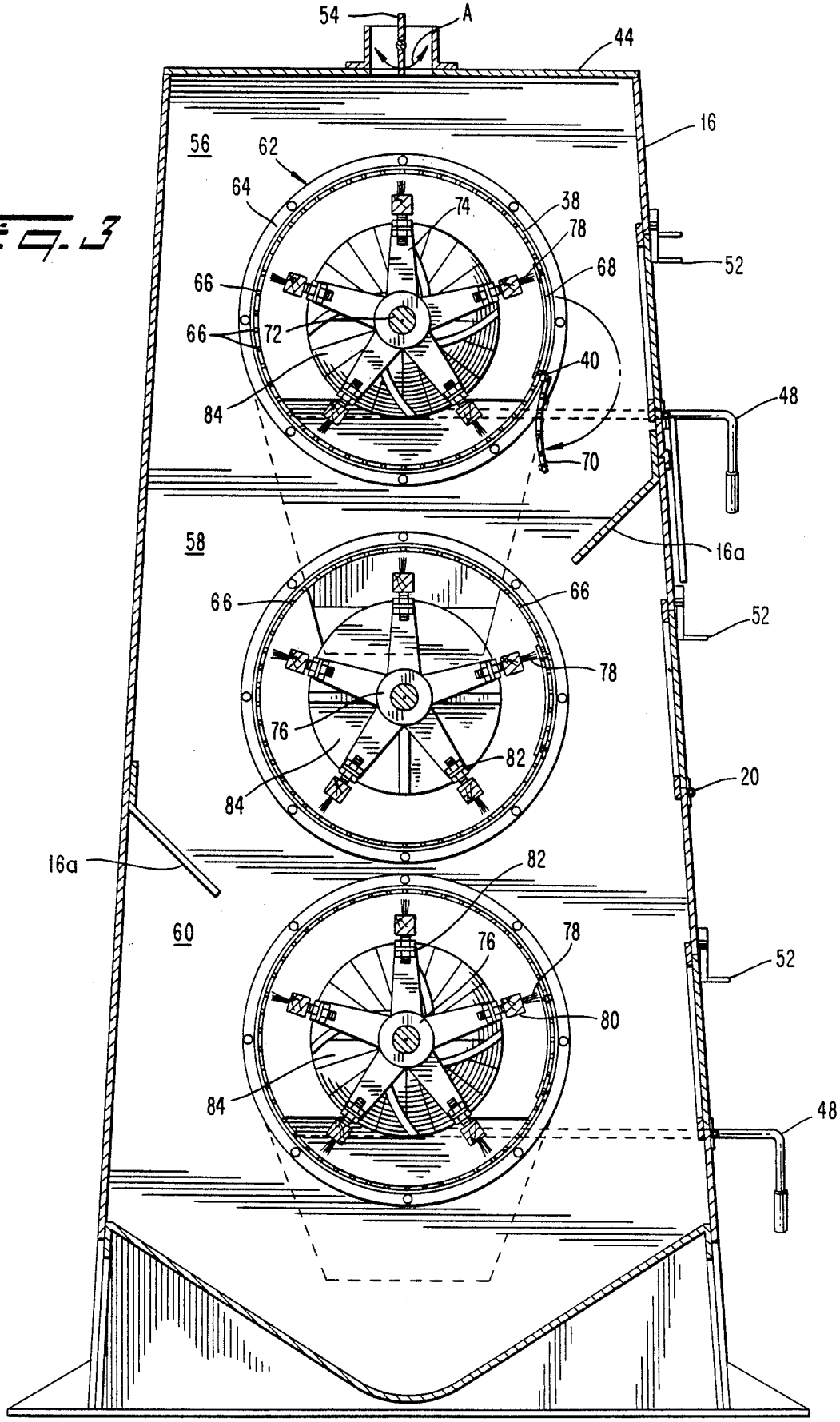
FIG. 3 is a side view, in elevation, of the mechanical cottonseed delinter of the present invention in which various portions of the side casing have been cut away so as to expose various operating elements of the machine.

With reference to FIG. 3, a side view of the machine is presented in which the machine frame has been removed so that the interior of the machine is shown in greater detail. Therein, it can be seen that three chambers are provided in vertically spaced relationship. A first chamber 56 is indicated as the uppermost chamber and receives the initial supply of cottonseed from the hopper 22. An intermediate chamber 58 is shown as is a bottom or final chamber 60. Each chamber or section is provided with substantially identical operating sections in series as will be further apparent in the description of FIG. 4. With respect to the arrangement in the upper chamber 56, a cage and brush assembly is shown as generally indicated by reference numeral 62. Therein, an outer cage 38 of perforated metal screening material is provided. The metal screening material is fixedly mounted to a stationary support 64. The screen material is of relatively heavy gauge metal and is provided with a series of perforations 66 extending around the periphery of the screen material 38. With reference to FIG. 5, the screen material 38 is provided with the perforations 66 which are of a predetermined size so as to permit the passage of moat therethrough but retain a cleaned seed inside the screen material 38. The geometric shape of the opening 66 may, therefore, be of various designs insofar as the perforations promote the passage of lint while retaining the seeds therein.

Each cage of the screen material is provided with an opening 68 so as to permit inspection and repair of any necessary parts interiorly of the cage of screen material 38. As previously discussed with reference to FIG. 1, a hinge arrangement is indicated at 40 so as to permit a door 70 to open and to permit the interior inspection and/or repair of any needed element.

Interiorly of the screen material 38 is a shaft 72 driven by the motor arrangement 34. The driving arrangement will be discussed later in greater detail with regard to FIGS. 4 and 6. Fixedly connected through any known means to the shaft 72 is a series of support members 74. The support members 74 extend from a central flange area 76 of the connection with the driven shaft 72. The support members 74 extend radially outwardly from the driven shaft 72 and carry thereon a series of brush members 78. The brush members are attached to the support members 74 through a brush holding and support member 80 which is connected, by any known connecting means such as nut and bolt connectors, to a flange 82 of the support member 74. The flange 82 is at a substantially 90° angle to the support member 74 so as to provide the brush member 78 with the proper orientation for trapping cottonseed between the brush members 78 and the stationary screen section 38.

FIG. 3 also shows the use of a plurality of cone-like elements on each driven shaft 72. The cone elements are indicated at 84. As can be seen from FIG. 3, the cone elements 84 in chambers 56 and 60 face in the same direction while the cone elements in chamber 58 face in an opposite direction. This corresponds to the direction of flow of the cottonseed through the machine as will be discussed later with reference to FIG. 4. The cone elements as shown in the sections 56, 58 and 60 are shown in greater detail in FIGS. 11 and 12. Reference may be had thereto for the following discussion. The cone elements 84 are provided with central openings 86 therethrough. The driven shaft 72 extends through the openings 86 and the cones 84 are fixedly attached thereto. The shaft 72 then drives the cone in the direction of rotation of the shaft 72. The cones of FIGS. 11 and 12 are provided on the driven shaft 72 so as to provide a centrifugal effect which throws the cottonseeds outwardly against the screen material 38 during the rotation of the driven shaft 72. Accordingly, the cottonseeds requiring delinting approach the cones in the direction of the area of reduced diameter of the cone. As the diameter of the cone increases, the airflow thereround is acted upon in a centrifugal manner, due to the rotation of the cone 84, so as to carry the cottonseed radially outwardly from the central portion of each section of the cottonseed cleaning arrangement. To further facilitate the centrifugal action, helical blade elements 88 are provided on each of the cones 84. Additionally, the back side 90 of each of the cones 84 are provided with vanes 92 which help to produce a cooling airflow so as to further prevent excess heat buildup in the cottonseed delinting machine. In effect, the blades 92 produce an action to further circulate the air through the machine in a more rapid manner.

With reference to FIG. 4, the interior of the machine is disclosed in greater detail with respect to each of the elements previously discussed. FIG. 4 provides a further operational viewpoint so as to assist in a complete understanding of the invention. In FIG. 4, the plenum chamber and variable opening arrangement is again shown for the sake of complete disclosure; however, in view of the foregoing discussions with regard to FIGS. 1 and 2, no further discussion is deemed necessary or appropriate at this time. The hopper 22 receives the cottonseed and delivers the cottonseed through a chute 94 to the first rotating section of the machine. The section 56 receives the untreated cottonseed for its first exposure to the delinting process. The seed is delivered through the chute 94 to a helical inlet region indicated at reference numeral 96. The shaft 72 is driven by a pulley arrangement 98 which will be discussed in greater detail with reference to FIG. 6. In any case, it can be seen from FIG. 4 that all three shafts 72 are driven simultaneously at the same rate of speed due to the pulley arrangement and driving connection.

The untreated cottonseed is delivered along the interior of the screen material 38 and is brought into contact between the screen material 38 and the brushes 78. As the brushes 78 are directly and fixedly connected to the support member 74 and to the driven shaft 72, the brushes are constantly driven at the same speed as the shaft 72. The screen material cage section 38 does not rotate. Due to the helical flow pattern provided by the inlet section 96, and due to the centrifugal force produced by the rotating cone arrangement 84 and the helical vanes 88, as discussed previously with respect to FIGS. 11 and 12, the cottonseeds are thrown radially outwardly against the screen and trapped between the rotating brushes and the stationary screen. Due to the length of each of the sections 56, 58 and 60, a plurality of rotating cones are used on each shaft 72. For purposes of illustration, only two cones are shown per shaft; however, it should be understood that more cones could be affixed to the shaft 72 if deemed necessary in order to ensure proper centrifugal action for keeping the seeds under the action of the centrifugal force. As the seeds are introduced into the section 56, they move from the left of the figure to the right of the figure.

A discharge chute is shown at reference numeral 100. The discharge chute 100 may have a degree of opening determined by the linkage 48 as previously discussed.

The degree of opening of the discharge gate 100 determines the amount of time any particular type of cottonseed will stay in the first rotating section 56. Upon discharge from the first rotating section 56, the seeds flow through channel 102 and are guided by an inlet chute 104 to the entrance area of the second section 58. As can be seen from FIG. 4, and as has been discussed with regard to FIG. 3, the sections 56, 58 and 60 are identical with the exception that section 58 is reversed with respect to sections 56 and 60. The reversal relates to the direction of the cones. As can be seen from FIG. 4, the cones are always provided with their helical vanes directed toward the incoming cottonseeds, the helical vanes 88 extending from the smallest diameter section of the cone to the largest diameter section of the cone. This again provides for the proper centrifugal force to act on the seeds as they traverse the various sections of the cottonseed delinting machine. Upon traversal of the length of the section 58, the cottonseeds are again directed through a discharge area identified at reference numeral 106 and which corresponds to the discharge door 100. A discharge chute 108 directs the cottonseeds into the third section 60 of the machine. The seeds again traverse the length of the section 60. At this time, the seeds are discharged through discharge chute 24. The seeds could be discharged into bulk carriers of predetermined size for transport for further processing, i.e., grading and sorting, prior to planting.

During the traversal of the seeds along the lengthwise direction of the machine, lint or moat has been removed from the seeds by the brushing action of the brushes 78 against the screen material 38. The lint or moat has escaped through the perforation 66 of the screen material 38 and has, due to the plenum chamber effect, gradually drifted toward the bottom of the machine for collection in the bottom of the machine 28 and its eventual removal by the centrifugal action acting through discharge pipe 26. The moat is extremely light and fluffy as it emerges from the perforations 66 and would have a tendency to float in the open chamber areas around the screen material 38 absent an arrangement for deflecting the moat toward the bottom 28 of the machine. A series of defleotor baffles (not shown) are arranged on the interior of the machine casing so as to function in conjunction with the amount of air brought in through the plenum chamber arrangement so as to keep the moat moving from the top of the housing to the bottom of the housing. This permits the moat, i.e., the delinted material, to more effectively be removed from the interior of the machine. The deflector baffles may be arranged along the interior of the housing in a predetermined pattern so as to promote a wave motion of the airstream and direct the moat toward the bottom 28 of the machine.

Figure 6:
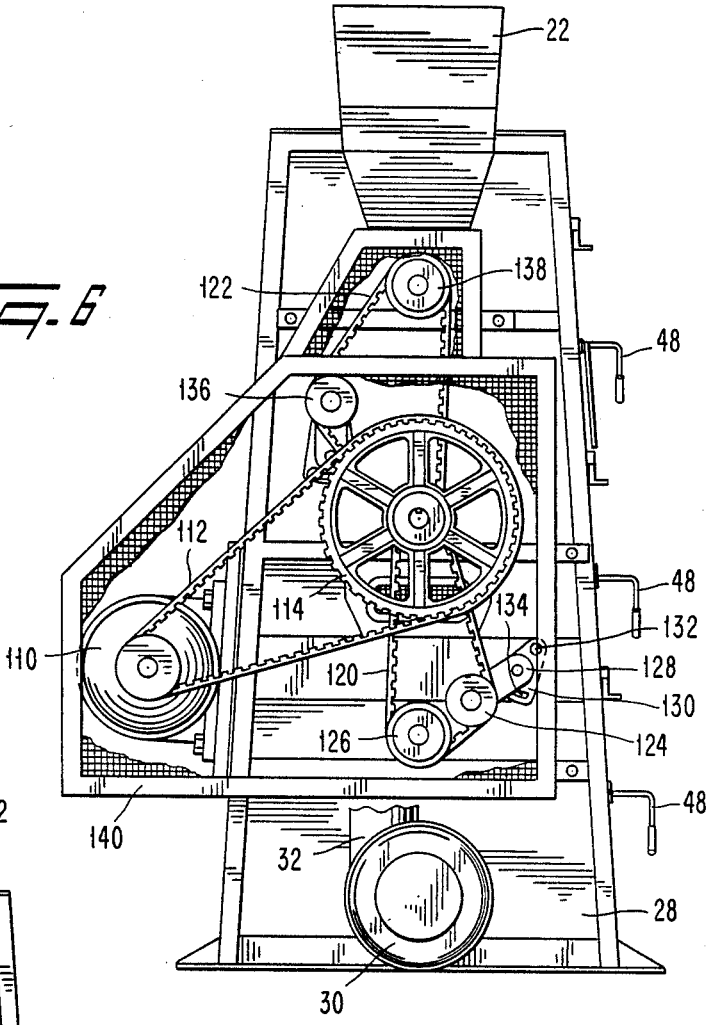
FIG. 6 is side elevation view of the drive system of the cottonseed delinting machine.

With respect to FIGS. 4 and 6, a more detailed discussion of the drive system is set forth. The drive system was generally indicated at reference numeral 98 in FIG. 4. With reference to FIG. 6, a drive motor 110 provides the motive power for the drive system. The drive motor drives a cog belt 112 which provides a positive driving connection to a driven pulley 114. The driven pulley 114 is directly fixed to a driven shaft 72 of the center section 58 of the cottonseed delinting machine. Concentric with the driven pulley 114 is a pair of driving pulleys 116, 118 (see FIG. 4). The driven pulleys 116, 118 are each in positive driving connection with a cog-toothed driving belt 120, 122, respectively. The belt 120 is in positive driving engagement with an idler pulley 124 and a driven pulley 126. The idler pulley 124 is also adjustable for tension as it is mounted on a link arm 128 of a bell crank-type member 130 which is fixedly connected at 132 to the frame of the machine. The link arm 128 may swing through an arc determined by the length of a slot 134 for determining the amount of tension on the belt 120. The driven pulley 126 is fixedly connected to the shaft 72 of the third section 60 of the machine. The belt 122 is also in positive driving engagement with an idler pulley 136 and a driven pulley 138 which is fixedly attached to the shaft 72 of the first section 56 of the cottonseed delinting machine. The idler pulley 136 also serves as an adjustable tension member for the belt 122 and functions in a manner identical with that discussed with respect to the tension adjusting member of the belt 120. Accordingly, additional description is deemed unnecessary and reference may be had to the preceding discussion with regard to the idler pulley 124 and its tension adjusting mechanisms 120 through 134. The complete drive mechanism is enclosed in a guard housing 140 so as to protect against incidental contact therewith which could lead to severe injury.

Figure 7:
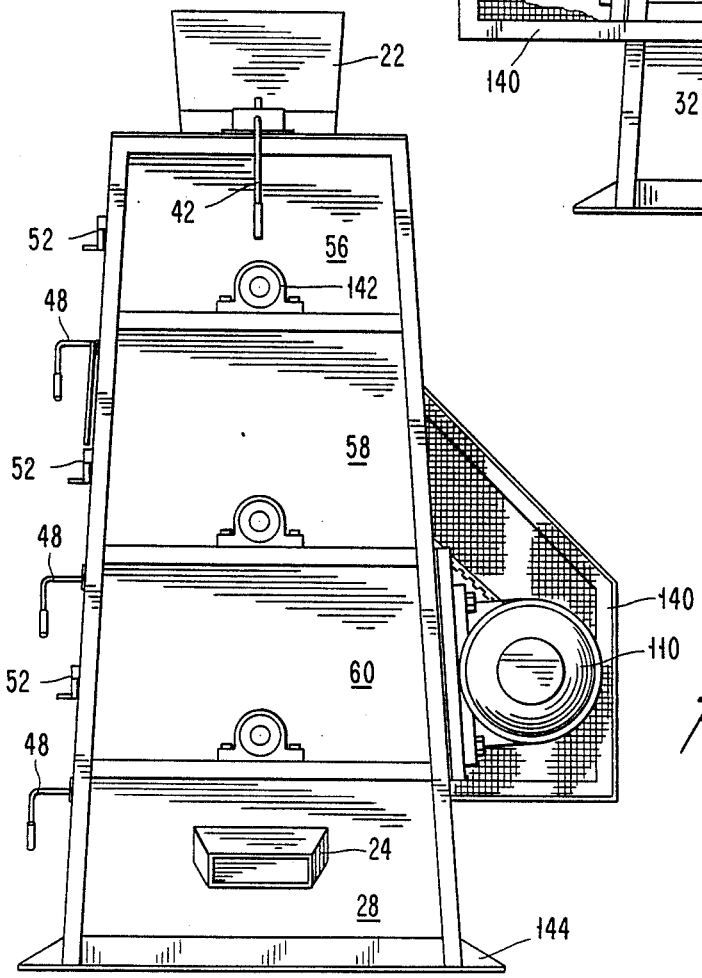
FIG. 7 is a side view, in elevation, of the casing arrangement for the cottonseed delinting machine.

With reference to FIG. 7, a side view of the machine is presented so as to better understand the relationship between the sections 56, 58 and 60. Therein, it can be seen that the hopper 22 receives the cottonseed and the discharge spout 24 discharges the seed therefrom. Each of the sections 56, 58 and 60 are securely connected by a connecting mechanism 142 so as to maintain proper alignment of the sections at all times. As the shafts 72 are driven by a combined drive system and directly driven therefrom, the correct alignment of the sections is of vital necessity so as to prevent warpage or other undue stresses on the plurality of shafts 72 and thereby prolong the life of the machine. Additionally, the machine may have a flat mounting base 144 to facilitate its proper mounting to any firm foundation providing the necessary support.

With reference to FIGS. 8, 9 and 10, the manner of operation of the door discharge adjustable chute arrangements are presented. In each of the drawings, the linkage arrangement 48 is shown in part detail as being received in a multi-position slot arrangement 146. The slot arrangement, while depicting three discrete positions, may be of the continuously variable type or may provide for a greater plurality of discrete positions for the linkage arrangement positioning mechanism. The linkage mechanism is connected with a door member 100 which is capable of assuming each of the positions as indicated in the FIGS. 8, 9 and 10 or any of a series of continually adjustable states. For example, in FIG. 8, the door 100 is shown as being totally closed. Under such condition, and with reference to FIG. 4, any cottonseed located in the top chamber or section 56 of the machine would remain in that section for a predetermined time until the door 100 is opened to some degree. Upon movement of the linkage mechanism 48, through the slot 146, and with reference to FIG. 9, the door 100 is opened to an intermediate position. In such an intermediate position, and again with reference to FIG. 4, the doors 100 would permit a predetermined amount of cottonseed to move from either the first chamber or section 56 to the second chamber or section 58 or to the third chamber or section 60 or, as an alternative, to the discharge duct 24. As previously discussed, among the some 130 different types of cottonseeds, many different types require substantially different periods of time in the delinting machine sections so as to properly delint and remove the moat from the seed. As such, an intermediate setting as indicated in FIG. 9 would permit a partial amount of the seed in any one section to move to the next section. With reference to FIG. 10, the door 100 is in a fully opened position as indicated by the linkage being positioned in the last section of the slot 146. As such, the maximum amount of cottonseed that can pass through each section, during a predetermined time, is passed from one treatment section to the next succeeding treatment section or to the discharge section.

The present invention is directed to a non-polluting, non-corrosive cottonseed delinting system. A series of brushes continually work the lint containing cottonseed against a screen member so as to remove the lint from the seed. Air is used to remove the lint from the sides of the drum and to move the lint from one section of the machine to the bottom section. This lint, as it is not destroyed as in other chemical processes, is in the form of moats or linters that may be pressed into bales and resold. The present process, as described in the foregoing section, will delint approximately 2200 pounds per hour and may be operated on a continuous basis.

The principles, preferred embodiments and modes of operation of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A delinting machine for delinting cottonseed, comprising:

a housing;

an inlet hopper;

a plurality of delinting sections vertically spaced from each other, each of said delinting sections including, a rotatably driven shaft having a support member fixedly connected thereto;

a brush member connected to said support member and rotated thereby;

a plurality of cone members fixedly connected to said driven shaft;

a screen member fixed to said machine concentric and stationary with respect to said shaft, said support member, said brush member, and said cone member, said rotating brush member brushing said cottonseed against said screen member thereby forcing lint through said screen member and off said cottonseed; and a variably movable door member for controlling a period of time in which said cottonseed is retained in each of said delinting sections so as to remove lint therefrom;

a drive means for driving each of said driven shafts;

an air inlet control means for controlling air circulation in said machine housing; and, a discharge duct for discharging delinted cottonseeds from said machine housing.

2. A delinting machine according to claim 1, further comprising a lint collection section in said machine vertically spaced below said plurality of delinting sections.

3. A delinting machine according to claim 2, further comprising a discharge conduit and centrifugal operator to remove said lint from said machine and to transport said lint away from said machine.

4. A delinting machine according to claim 1, wherein said air inlet control means includes a rotatable member positioned in a vent provided in said machine frame and operable to control air ingress interiorly to said machine.

5. A delinting machine according to claim 1, wherein said drive means provides a direct drive connection to the driven shaft of one of said plurality of delinting sections.

6. A delinting machine according to claim 1, wherein said drive means further comprises a driven pulley and at least two drive pulleys concentric with each other.

7. A delinting machine according to claim 6, wherein said drive means further comprises at least two further driven pulleys directly connected to driven shafts of said plurality of delinting sections.

8. A delinting machine according to claim 7, further comprising at least two idler pulleys connected by a belt driving arrangement with said further driven pulleys.

9. A delinting machine according to claim 8, wherein said idler pulleys are adjustable to vary tension in said belt driving arrangement.

10. A delinting machine according to claim 1, wherein said plurality of delinting sections includes an inlet section, an intermediate section and an outlet section, said inlet section provided with helical guide vanes on said driven shaft so as to impart a spinning motion to said cottonseeds introduced into said inlet section.

11. A delinting machine according to claim 1, wherein said cone members are connected to said driven shaft so as to present an increasing frontal area to said cottonseed as said cottonseed travels through each of said plurality of sections in a lengthwise direction.

12. A delinting mechanism according to claim 11, wherein said increasing frontal area imparts a centrifugal effect to said cottonseed so as to push said cottonseed radially outwardly therefrom and in contact between said screen member and said brush member.

13. A delinting mechanism according to claim 11, wherein said cone members have helical vanes on said frontal area so as to impart a further spinning motion to said cottonseed.

14. A delinting mechanism according to claim 11, wherein said cone members have blades on a side downstream from said direction of travel of said cottonseed.

15. A delinting machine according to claim 14, wherein said blades produce additional airflow to assist in cooling said cottonseeds.

16. A delinting machine according to claim 1, wherein said are provided with doors adjustably positioned so as to control the discharging of said delinted cottonseeds.

17. A delinting machine according to claim 16, wherein lever means are connected to said doors for adjustably positioning said doors.

18. A delinting machine according to claim 1, wherein said screen member for each of said sections is provided with perforations of a size which will not permit passage of said cottonseed therethrough.

19. A delinting machine according to claim 1, wherein said machine is provided with a plurality of openable doors to permit access and inspection of interior portions of the machine.

20. A delinting machine according to claim 1, wherein said screen member of each section is provided with a plurality of openable positions to permit access and inspection of interior sections of said screen member.

21. A delinting machine according to claim 1, wherein said housing is provided with a series of baffles interiorly thereof to direct air from said air inlet control means in a predetermined circulation pattern and transport said lint to a bottom portion of said housing.

* * * * *